US010964175B2

(12) United States Patent
Vankirk et al.

(10) Patent No.: US 10,964,175 B2
(45) **Date of Patent: *Mar. 30, 2021**

(54) AUTOMATED TELLER MACHINE WITH ESCROW

(71) Applicant: Diebold Nixdorf, Incorporated, North Canton, OH (US)

(72) Inventors: Thomas A. Vankirk, Medina, OH (US); William Daniel Beskitt, Canton, OH (US)

(73) Assignee: Diebold Nixdorf, Incorporated, North Canton, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/793,230

(22) Filed: Feb. 18, 2020

(65) Prior Publication Data

US 2020/0184781 A1 Jun. 11, 2020

Related U.S. Application Data

(63) Continuation of application No. 15/767,362, filed as application No. PCT/US2016/056381 on Oct. 11, 2016, now Pat. No. 10,565,832, which is a continuation of application No. 14/880,324, filed on Oct. 12, 2015, now Pat. No. 9,646,465.

(51) Int. Cl.

| | |
|---|---|
| ***G07F 19/00*** | (2006.01) |
| ***G07D 11/14*** | (2019.01) |
| ***G07D 11/50*** | (2019.01) |

(52) U.S. Cl.

CPC ..... *G07F 19/205* (2013.01); *G07D 11/14* (2019.01); *G07D 11/50* (2019.01); *G07F 19/202* (2013.01); *G07F 19/203* (2013.01)

(58) Field of Classification Search

None

See application file for complete search history.

(56) References Cited

U.S. PATENT DOCUMENTS

| | | | | |
|---|---|---|---|---|
| 6,290,070 | B1 | 9/2001 | Graef et al. | |
| 2005/0189266 | A1 | 9/2005 | Fujita et al. | |
| 2007/0034683 | A1* | 2/2007 | Eastman | G07F 1/041 235/379 |
| 2013/0075467 | A1* | 3/2013 | Graef | G06Q 20/1085 235/379 |

FOREIGN PATENT DOCUMENTS

| | | | |
|---|---|---|---|
| CN | 1645421 | A | 7/2005 |
| CN | 101178820 | A | 5/2008 |
| EP | 1517274 | A2 | 3/2005 |
| EP | 1921585 | A2 | 5/2008 |

OTHER PUBLICATIONS

International Search Report and Written Opinion for corresponding PCT application.

Office Action issued in the corresponding Korean application.

Chinese search report for corresponding Chinese application, dated Apr. 3, 2019.

* cited by examiner

*Primary Examiner* — Kristy A Haupt

(74) *Attorney, Agent, or Firm* — Black, McCuskey, Souers & Arbaugh LPA

(57) ABSTRACT

An Automated Teller Machine has a housing having an aperture through which documents may pass between the interior and the exterior of the housing. At least one escrow area is defined in the housing. A document transport system extends within the housing for the transport of documents between the aperture and the escrow area.

15 Claims, 3 Drawing Sheets

AUTOMATED TELLER MACHINE WITH ESCROW

CROSS-REFERENCE TO RELATED APPLICATIONS

This application claims priority to and the benefit of U.S. patent application Ser. No. 15/767,362 filed 11 Apr. 2018, now U.S. Pat. No. 10,565,832 issued 18 Feb. 2020, which is the U.S. National Stage of International Patent Application No. PCT/US16/56381 filed 11 Oct. 2016, which claims priority to and the benefit of U.S. patent application Ser. No. 14/880,324 filed 12 Oct. 2015, the contents of all of which are hereby incorporated by reference in their entirety.

BACKGROUND

This relates in general to Automated Teller Machines (ATM) also known as Automated Banking Machines.

One category of ATM includes machines capable of conducting a wide variety of traditional banking transactions including acceptance of cash and/or checks for deposit, check cashing, and withdrawals/dispensing of cash, also referred to herein as currency or notes. In certain locations globally and especially in certain countries, the daily transaction volume of an ATM can be substantial and may even exceed the physical capacity of the machine to receive documents and/or exhaust the available supply of currency notes available to dispense for withdrawals.

Currency/notes, checks and other sheet materials, generally referred to as documents, that are accepted and/or dispensed by an ATM, are typically housed in containers, such as bins or removeable cassettes, while the documents are stored in the machine. Typically, documents are dispensed from the cassettes and presented by the ATM through an aperture or opening in a user interface, typically in the front facing or top of a housing of the ATM. In some ATM, documents may be accepted through the user interface for deposit and the like and then placed into a cassette. Thus, as cassettes become full or empty, periodically they must be either reloaded or unloaded or removed and replaced with loaded or empty cassettes.

In general, the reload, unload or removal of one or more cassettes in an ATM requires that the normal operation of the ATM be suspended. Also, reload, unload, or removal/replacement of a cassette typically requires personnel to access the ATM through a secured safe portion (chest) of the ATM. For example, personnel may need to access the chest through a locked rear or forward access door(s) to facilitate reload, unload, or removal/replacement of a cassette in the chest. Once the cassettes have been reloaded or unloaded or the cassettes have been removed and replaced, it may then be necessary to reboot or activate the ATM in order to place the ATM back into service.

The reload, or unload, or removal/replacement of cassettes requires documents to be transported to and/or from the ATM. For replenishment, such documents may be preloaded in to cassettes to be taken to the machine or taken to the machine separately and feed into the cassettes at the ATM. For depletion, loaded cassettes may be removed from machine or documents may be dispensed from the machine and taken away separately from the cassettes. While efforts have been made in the design of ATMs, including the cassettes, to minimize opportunities for misuse, fraud, or pilferage, and other precautions have been taken to safeguard the transport of documents, there is always some risk of such events occurring during the handling and transport of such documents. Additionally, it is often the case that during such operations the secured or safe portion may be open or exposed. Therefore, such activities are normally carried out by or in the presence of armed couriers. Often, more than one person is assigned to any task where there is access to documents going to or coming from an ATM. Because numerous individuals may be involved in the reload, or unload, or removal/replacement of cassettes, this is often a time consuming and expensive process. The need to reload, or unload, or remove/replace cassettes periodically is a cost and/or loss to the ATM owner/operator because of the process described above and because the ATM must be either powered down completely or at minimum temporarily disabled from transaction processing.

SUMMARY

This relates more specifically to Automated Teller Machines including document recycling, for example ATMs that are configured to accept currency bills, notes or other documents deposited by one customer, identify and store those documents in the machine, and potentially later selectively dispense those documents to subsequent customers.

One such ATM, which is capable of receiving and dispensing currency, may identify a particular type and denomination of currency, storing the currency in the ATM and later dispensing the currency to a customer. It is believed that such an ATM may have the ability to operate for longer periods of time before requiring currency replenishment or depletion, as compared to an ATM that receives or dispenses only.

In at least one embodiment, an ATM with currency recycling has a document handling mechanism which includes an input/output area in which a customer may insert documents that are to be deposited and from which a customer withdrawing documents may receive documents.

In at least one embodiment, a customer may deposit documents or notes singly or in a stack through an opening in a user interface of an ATM. These documents may be moved from the input/output area into a central transport, also referred to as note transport. In an unstack area, documents deposited in a stack may be are removed from the stack one by one by an unstack device and separated into a stream of single separate documents. These documents may then move along a document path in the central transport.

In this exemplary ATM, documents may move past a document type identifier device or validator. The identifier device may operate to classify the documents as either identified as a type of document that is acceptable to the machine or unidentifiable as a type of document that is acceptable to the machine. The identification device preferably operates to identify the type and/or denomination of each document. Identified acceptable documents may then be directed into an escrow area while unidentified unacceptable documents are directed into a reject area of the ATM.

Additionally, in this example, a customer may be informed of any unidentifiable documents inserted through input and output devices via a display on the machine interface. Any unidentified documents may then be returned from the reject area to the customer. Alternatively, depending on the programmed configuration of the machine and/or inputs by the customer, these documents may optionally be routed through the central transport again past the identification device to repeat the process above.

Further, in this example, identified documents are initially held in the escrow area. The output devices on the interface of the machine indicate indicia to the customer representative of the type and/or value of the identified documents. This type and value data may be calculated by the control system of the machine. The customer may then select whether to have such documents returned or deposited in the machine. If the customer elects to have the documents returned, the documents are passed out of the input/output area through the opening in the housing and the customer's account is not credited for the value of the documents.

If the customer elects to deposit the documents, the documents are again moved through the central transport, preferably in a stream of rapidly moving separated documents. The documents may then be again identified by the identification device for identification. Additionally or alternatively, the system may identify the documents by memory of the identification when they were first identified by the identification device.

Then the identified documents are preferably routed by the control system of the machine to selected storage areas. The storage areas are locations in which documents of the particular types are stored in the machine. The storage areas in the machine of the preferred embodiment are cassettes in a chest. The control system of the machine operates to cause the customer's account to be credited for the value of the deposited documents.

That same customer who deposited these documents or some subsequent customer using the machine to make a withdrawal may receive some or all of these same documents that have been previously stored in the storage areas. Document dispensing mechanisms associated with the storage areas may selectively remove documents from the storage areas responsive to the control system and route the documents to the central transport of the machine. As the documents move through the central transport, they may pass the identification device via the note transport, to verify the type and denomination of each document being dispensed. This would assures that the initial identification of the documents made when deposited in the machine was correct, and may validate the identification of documents otherwise loaded into the machine. This verification prior to dispensing may reduce the risk that a customer withdrawing documents from the machine will be given an incorrect document. The documents may be removed from multiple storage areas concurrently to facilitate rapid operation of the machine and may be controlled in movement through the remote transport segments and the central transport to assure that they move as a stream of separated documents as they pass the identification device.

The identified documents to be dispensed to the customer are moved by the central transport to a pre-presentation area. From the pre-presentation area, the documents are presented to the customer through the opening in the housing of the machine. The control system of the machine operates to cause the customer's account to be charged or debited for the documents that have been withdrawn.

DETAILED DESCRIPTION

Figure 1:
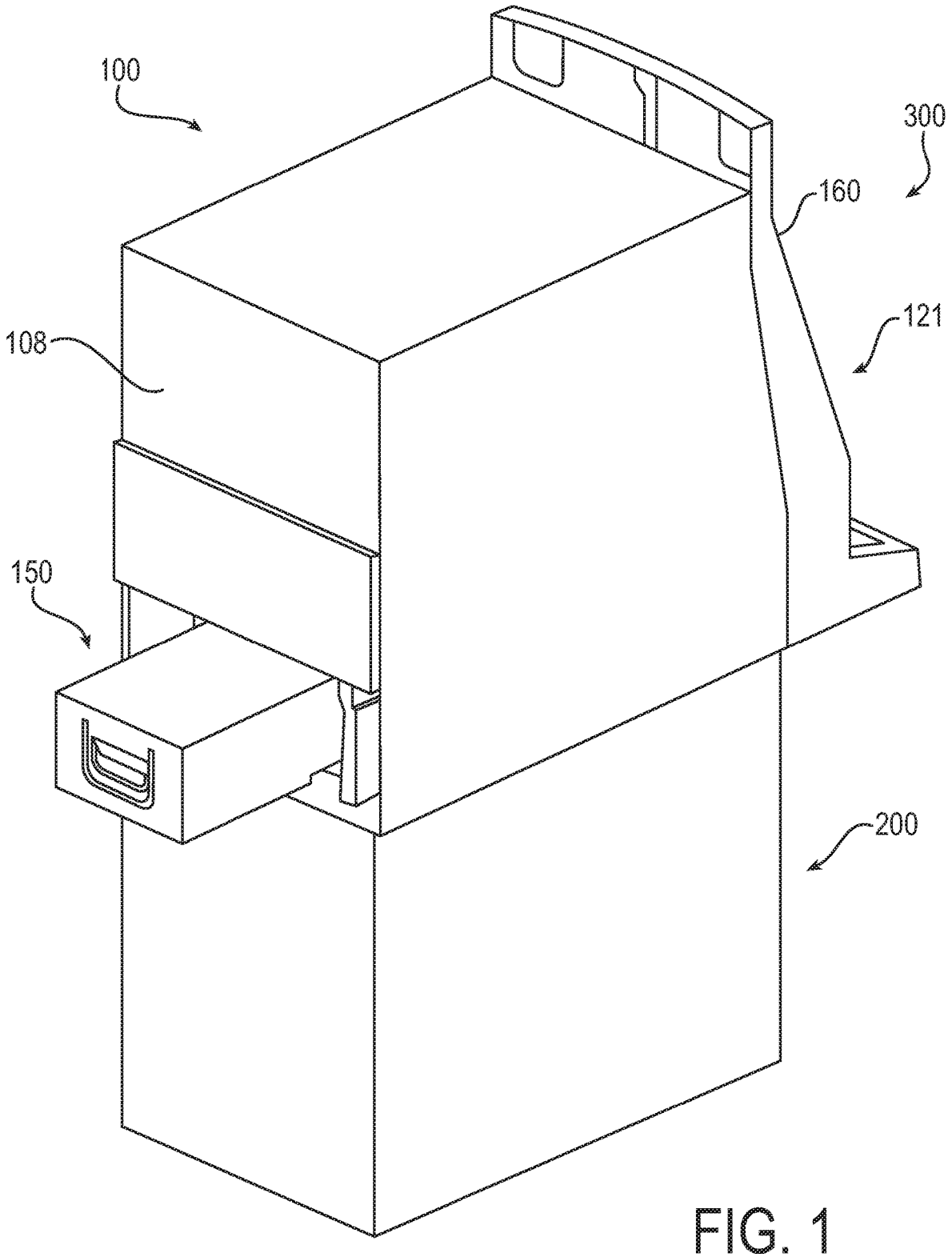
FIG. 1 is a rear perspective view of an Automated Teller Machine, shown with an escrow cassette partially removed.
Figure 2:
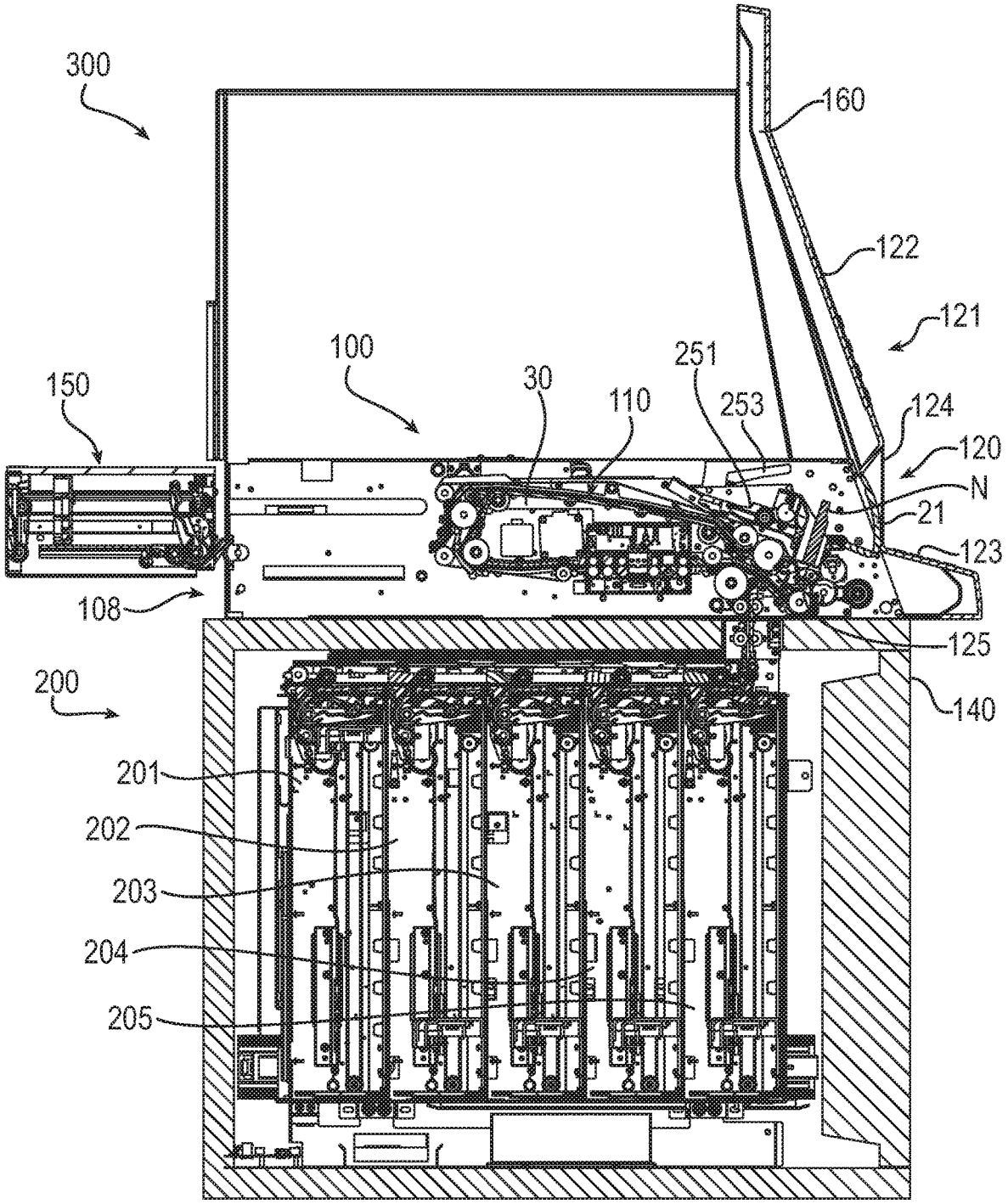
FIG. 2 is a side cross-sectional view of the ATM of FIG. 1.
Figure 3:
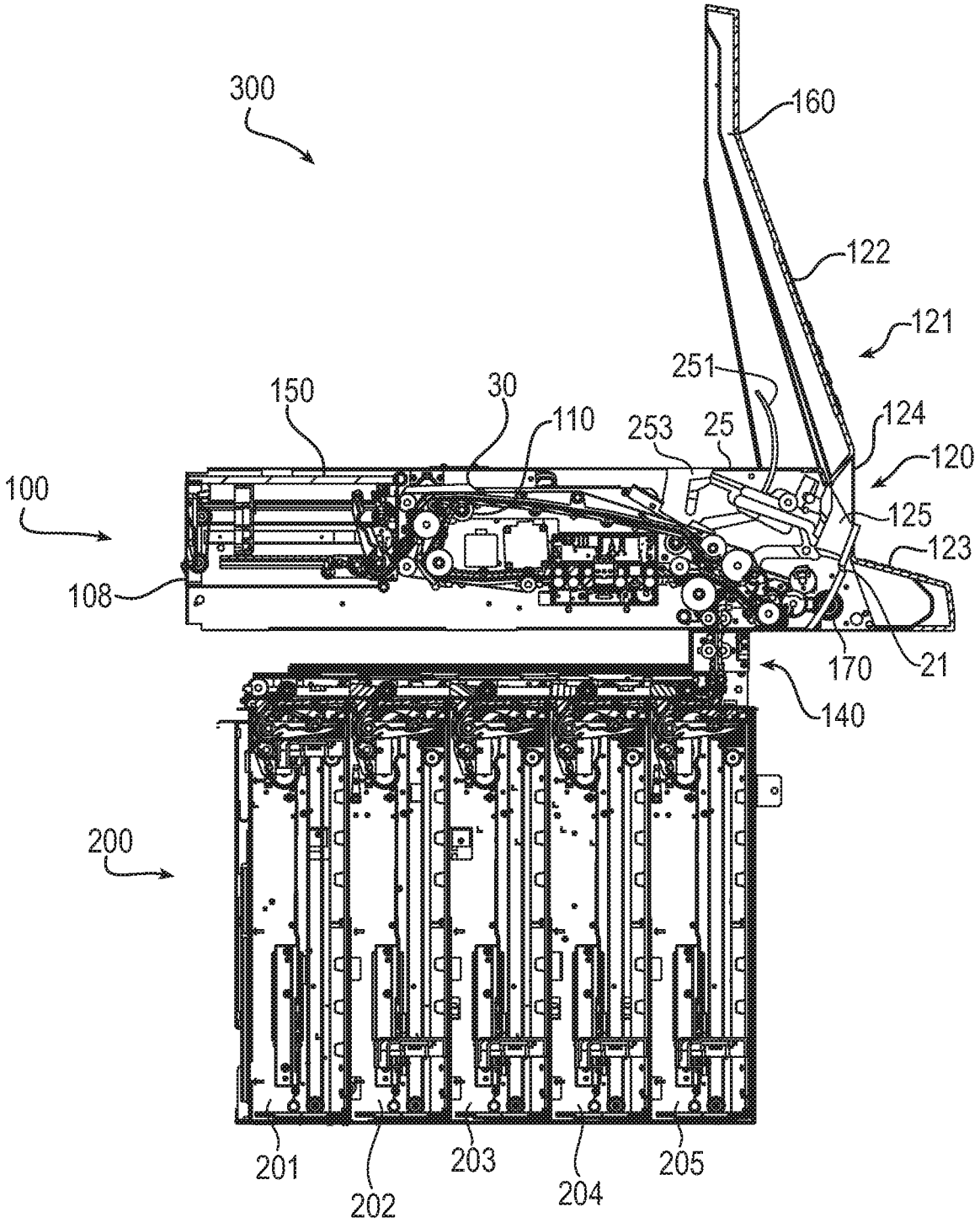
FIG. 3 is a view similar to FIG. 2, except with a portion of the housing and the chest removed and showing the escrow cassette in the normal operating position.

There is illustrated in FIGS. 1-3 an Automated Teller Machine (ATM) 300. The ATM has a housing 100, which includes a user interface, generally indicated at 121. The user interface 121 includes devices and components operable by a user for control and use of the ATM. For example, the user interface 121 may include a display 122, a keypad 123 such as an encrypting pin pad (EPP), a card reader, located for example at 124, which may be a magnetic card reader or smart card or chip-in-card reader operable by manual insertion and retraction of a card into and out of a card slot or motorized card movement, configured for either short-edge or long-edge insertion into the card slot, such as for example a Diebold ActivEdge™ card reading device, or any other device suitable for operation of the ATM 300. A receiver module 125, accessed through an opening 120 in the user interface 121, is configured to receive one or more notes or documents for deposit or processing, such as for example a stack of currency notes, and also to dispense one or more currency notes such as a stack of bills in any denomination or combination. In another embodiment, the ATM 300 may be configured to additionally receive and verify checks or other negotiable instruments, or bearer instruments. Other components and devices of the user interface 121 may include one or more displays, touch screen displays, audio speakers, microphones, biometric devices such as iris scanning devices, fingerprint reading devices, voice recognition devices, user or facial recognition devices, infrared transmitters and receivers and other devices which are capable of receiving or providing information or data from and to users of the machine, or any other device suitable for interaction between a user and the ATM 300.

The machine 300 may optionally include other devices such as a receipt printer (not shown) that produces receipts to customers as records of machine transactions. Other possible devices include a journal printer (not shown) for making a paper record of transactions and a passbook printer (not shown). A check imaging device (not shown) may also be included for purposes of producing electronic images of checks deposited into the machine as well as for canceling such checks. Such a check imaging device may be of the type disclosed for example in U.S. Pat. No. 5,422,467.

Other devices include video cameras (not shown) for connecting to a remote location, an envelope deposit accepting mechanism (not shown), ticket printing devices (not shown), devices for printing statements (not shown), and other devices.

The machine 300 also includes a control system, schematically indicated at 30, which may be located in the housing 100. The control system 30 includes one or more programmed microprocessors and accompanying control circuitry in operative connection with the components of the machine and controls the operation thereof in accordance with programmed instructions. The control system 30 also provides for communications with other computers concerning transactions conducted at the machine 300. Such communications may be provided via a connection to a proprietary transaction network, via digital or optical cable, telephone lines or wireless connection, or any other suitable arrangement for communication between the ATM 300 and another computer(s).

For purposes of this description except where indicated otherwise, the words "documents", "sheets", "notes" and "currency" are used interchangeably to refer to materials received, transported, stored and/or dispensed by the machine 300 in any of its various embodiments. As known in the art, the process of recycling involves receiving documents singly or in bulk from a customer via the user interface, identifying the type of documents deposited, and storing the documents in one or more cassettes within the machine. The stored documents may then be selectively retrieved and provided as withdrawals from the machine, as further described.

As illustrated in FIGS. 1-3, and previously discussed, the ATM 300 includes a housing 100, generally illustrated as an upper unit, although such configuration is not required, and a chest 200, generally illustrated as a lower unit, although such configuration is not required. The housing 100 includes the receiver 125 and a receiver carriage assembly 25, a housing note transport conveyor 110, a validator 105, an escrow area or device 150 for example in the form of an escrow cassette as further described below, and upload/download note path 140. The front fascia 160 forms part of an exterior facing user interface by which the ATM is operated. The user interface may include—in addition to the display, keypad and card reader—other mechanical and/or contactless or wireless card reading devices, one or more cameras, biometric reading or sensing devices, wireless communication devices such as Near Field Communication (NFC) receivers and transceivers or Wi-Fi "hotspot" connections to networks and portable devices such as smart phones, audio speakers, microphones, earplug jacks, mirrors, keypad shields, and lights for general illumination and indicator lights such as at the card reader and/or at the deposit/dispense opening.

Located in the chest 200 are multiple cassettes 201, 202, 203, 204, and 205 configured to receive documents, such as notes, or checks or bills or the like. In the illustrated embodiments, the cassettes 201, 202, 203, 204, and 205 are oriented vertically to stack notes or documents horizontally therein. However, other orientations of the cassettes can be made, such as horizontal or at any suitable angle between horizontal and vertical. Notes and documents (these terms used synonymously herein to refer to any type of currency, voucher, ticket, paper, sheet or product which can be received, transported or moved by the ATM 300) that are identified and approved by the validator 105 are transported via the upload/download path 140 to one of the cassettes 201, 202, 203, 204, and 205 per programmed control logic of the ATM 300. As further described, the control and operation of the various gates, document and note transport mechanisms and cassettes is performed by a control system, for example located in the housing 100, configured, and programmed for operational control of note transport mechanisms for the described movement of documents in the ATM 300.

In a deposit operation, one or more notes or documents may be placed in the receiver 125, which may be for example be in the form of a box or compartment accessible through the opening 120 in the user interface 121. Notes may be clamped or gripped in the receiver 125 and the receiver may then be retracted into the housing 100. The notes are thereafter removed from the receiver 125, sent through the validator 105, and temporarily stored in the escrow cassette 150.

In one process, the analysis of the notes by the validator 105 produces signals indicative of note type and denomination or monetary amount, or a rejection of the note as invalid. These signals are transmitted to the control system 30, which controls the note transport to direct the notes to a delivery/reject area in the housing 100.

Then, identified documents suitable for acceptance and deposit may then be routed to the escrow cassette 150. The routing of identified sheets to the escrow position is optional depending on the programming of the control system 30 of the machine 300 or customer inputs to the interface of the machine 300. Notes classified as acceptable and identifiable may be directly routed to any of the cassettes 201, 202, 203, 204 and 205 for storage and possibly later re-dispensing.

In this example, the control system 30 controls transaction flow for analysis of notes and documents and routing to the reject, delivery, and escrow areas and cassettes.

If a note is not identifiable or identified as unacceptable, that note may be routed to a reject position for return to the customer via the receiver 125. Note stacking, unstacking, and identifying/validating steps may be performed concurrently as each document in the stream of documents passes through the note transport. Preferably, notes are continuously directed to the escrow or reject positions until the deposited note stack has been completely unstacked.

Notes that are not acceptable, such as, for example, unidentifiable sheets, and sheets that appear suspect, may be returned to the customer through the user interface 121 via the receiver 125. This can be done by the machine 300 after displaying to the customer, through the user interface display, information on the number of documents that were unidentifiable or unacceptable in the deposit stack that they submitted. The control system may also calculate a value of the acceptable documents and the customer would be advised through the interface of the value of the documents that have been properly identified.

In the illustrated embodiment, the escrow cassette 150 is located in the housing 100 in an area spaced from the user interface 121 and opening 120, and more particularly, in this example, proximate to a back side 108 of the ATM 300. In other embodiments, the escrow cassette 150 may be located toward the middle of the housing 100 or even proximate the front fascia 160.

The escrow cassette 150 is preferably removeable from the housing 100. This may further enable removal of rejected or diverted notes and/or replenishment and/or depletion of notes of any of the cassettes 201, 202, 203, 204, and 205 by upload/download operation as described. As illustrated, the escrow cassette 150 is mounted to slideably engage the housing directly, although such is not required. Alternatively, the escrow cassette may be mounted on rollers, track, fabricated slides, or any other arrangement suitable to facilitate removal and insertion of the escrow cassette 150 from and to the housing 100. In other embodiments, the escrow cassette 150 may be fixed in the housing 100 and the interior of the escrow cassette 150 may be accesses through an aperture in the escrow cassette 150, which may optionally include a moveable cover. Further, in the illustrated embodiment, opening is provided in the back side 108 for removal of the escrow cassette 150 from the housing 100. However, such an opening maybe placed anywhere desired, as practical, in the housing 100. Additionally, it is contemplated that that the escrow cassette 150 may be removeable from an open or exposed housing, rather than through an aperture. For example, the escrow cassette 150 may be lifted out of position when the machine 300 is in a service state, such as when the housing 100 is opened or when the contents are extended there from. In such a case, the escrow cassette may mount on mating terminals in the housing 100, may engage bolts or other fasteners, or may cooperate with any other suitable engagement to retain the escrow cassette in the housing 100.

In one operational scheme, when the machine 300 determines that certain documents may be unidentifiable or unacceptable a user may be given the option to instruct the machine 300 to reprocess the documents to again try to identify the documents and categorize them as acceptable. In such a scheme, the machine 300 may be programmed to run the rejected document(s) back through the central transport in the manner previously done with the deposited stack. Preferably, only the unidentifiable or unacceptable are rechecked. Alternatively, however, all of the documents, including the documents that have been identified and categorized as acceptable, may be rechecked. The procedure for recheck may be preprogrammed into the machine 300 or may be dependent upon selection from the customer.

If only the initially rejected documents are re-checked, and any determined to be acceptable, the control system will recalculate the number and/or value of the acceptable documents. The customer may then be given various options depending on the situation that arises, such as to compete the deposit and return any remaining unidentified or unacceptable documents, or to cancel the transaction in its entirety. Further, the machine 300 may be programmed to perform other variations of these operational sequences for receiving, validating, accepting, or rejecting notes. In the instance where the rejected stack is to be returned to the customer, it may be delivered to the customer via the receiver 125.

If so programmed, the machine 300 may hold the identified documents in the escrow cassette 150 until it receives the customer input command to deposit the notes. At that point, the note transport may be activated to transfer notes from the escrow cassette 150 to one of the storage cassettes 201, 202, 203, 204, and 205 via the upload/download note path 140.

In one operational example, the machine 300 may provide for crediting the customer's account for amounts that they indicated they wished to have returned but did not take. If the machine 300 is programmed to operate in this manner the documents in the escrow stack will be stored according to their type and denomination in the various storage areas in the cassettes 201, 202, 203, 204 and 205. In this case, the control system will operate to credit the customer's account for a deposit. This may be done by the control system updating account data stored in memory in a machine at the customer's financial institution and/or by exchanging transaction messages with a remote computer system that tracks debit or credit card transactions for reconciliation.

In another operational example, the retracted documents may be stored in one of the cassettes 201, 202, 203, 204, and 205 and the machine may be programmed to detail the incomplete transaction and commit the incomplete transaction to memory and/or transmit the incomplete transaction to another computer. This may occur, for example, the user forgets to take a document(s) or is distracted while performing their transaction. The memory of the machine or other connected transaction systems may store this record of the incomplete transaction, such that the next time the customer accesses the machine, or other computer of the connected transaction system, the user may be notified of the fact that they had an incomplete transaction. The interface of the machine 300 may be used to notify the customer of the incomplete transaction and may prompt them concerning completion, reversal or other options relating to the transaction. The user may then input instructions to complete or otherwise close the transaction. This feature may limit the customer's options for completing the transaction to the particular machine where the incomplete transaction occurred or may be accessible from the other computer of the transaction system, such as, when the record of the incomplete transaction is stored in the memory of a transaction system which is connectable to many machines, the customer may be allowed to complete the transaction at a different machine.

It is expected that in most cases when a customer has deposited documents in the machine, they will choose to have funds credited to their account. In the ensuing transaction flow, the customer would indicate through the user interface that they wish to make a deposit. The control system would put the machine 300 in deposit mode and proceed accordingly. This is done in the manner previously described for the deposited stack.

The identification of the bill type may be used to selectively route each document to the storage area where documents of that type are stored, e.g. cassette 201, 202, 203, 204, and 205. It should also be understood that the memory connected to the control system of the machine 300 may preferably programmed to record the type of document held in the escrow stack and to compare the document type determination made in the initial pass to the type determination made in the second pass. In the event of an error or inconsistency, a divert gate may be used to route any irregular documents to the delivery/reject area instead of moving them down into a storage location in the machine 300, or moving them into another selected storage location.

In at least on process, each note undergoes analysis in the manner described and if the note is identified and validated, the machine continues in deposit mode and each note is dispatched to an appropriate storage location, e.g. one of cassettes 201, 202, 203, 204, and 205. In such an operation, notes may be moved concurrently toward different storage locations under the control of the control system.

While principles and modes of operation have been explained and illustrated with regard to particular embodiments, it must be understood, however, that this may be practiced otherwise than as specifically explained and illustrated without departing from its spirit or scope.

What is claimed is:

1. An automated teller machine, comprising:

a lower unit including:

a chest including one or more storage cassettes for storing documents; and an upper unit including:

a housing having an opening through which documents can pass between the interior and the exterior of the housing, and defining an access opening separate from the opening through which documents can pass;

a document receiver proximate the opening for receiving documents to be deposited into or dispensed from the automated teller machine;

an escrow area defined within the housing where the escrow area includes an escrow cassette disposed within the housing, where the escrow cassette is removable from the housing through the access opening;

a document transport system extending within the housing between the opening and the one or more storage cassettes and capable of transporting documents to and from the one or more storage cassettes and where the document transport system extends between the escrow area and the lower unit to transport documents between the escrow cassette and the one or more storage cassettes; and a validator disposed within the housing along a path of the document transport system for identification and categorization of documents wherein the documents are routed along the document transport system based at least in part upon the categorization by the validator, and wherein removal of notes from the one or more storage cassettes is enabled by upload operation to the escrow cassette and removal of the escrow cassette from the housing, and replenishment of notes to the one or more storage cassettes is enabled by insertion of the escrow cassette into the housing and download operation to the one or more storage cassettes.

2. The automated teller machine of claim 1, where the housing has a front fascia and the opening through which documents can pass is formed in the front fascia.

3. The automated teller machine of claim 2 further comprising a user interface including a display, where the display is disposed in the front fascia.

4. The automated teller machine of claim 3 where the access opening is opposite the front fascia.

5. The automated teller machine of claim 4, where the escrow area is spaced from the front fascia.

6. The automated teller machine of claim 1 where the document transport system is configured to transport documents between the escrow area and the document receiver.

7. The automated teller machine of claim 6 where the validator is configured to identify and categorize documents when in transit between the escrow area and the document receiver.

8. The automated teller machine of claim 1 where the escrow area is configured to allow for the addition or subtraction of documents from the housing directly from the escrow area.

9. An automated teller machine, comprising:

an upper unit including:

a housing having a front fascia with an opening formed in the front fascia through which documents can pass between the interior and the exterior of the housing, the housing defining an access opening opposite the front fascia;

a document receiver proximate the opening for receiving documents to be deposited into or dispensed from the automated teller machine;

an escrow area defined within the housing including an escrow cassette disposed within the housing where the escrow cassette is removable from the housing through the access opening; and a document transport system extending within the housing between the opening and the escrow cassette and capable of transporting documents to and from the escrow cassette; and a validator disposed within the housing along a path of the document transport system for identification and categorization of documents wherein the documents are routed along the document transport system based at least in part upon the categorization by the validator, and wherein removal of notes from the automated teller machine is enabled by upload operation to the escrow cassette and removal of the escrow cassette from the housing, and replenishment of notes to the automated teller machine enabled by insertion of the escrow cassette into the housing and download operation.

10. The automated teller machine of claim 9 further comprising a user interface including a display, where the display is disposed in the front fascia.

11. The automated teller machine of claim 9, where the escrow area is spaced from the front fascia.

12. The automated teller machine of claim 9, further comprising a chest including one or more storage cassettes for storing documents, and where the document transport system further extends between the escrow cassette and the chest to transport documents between the escrow area and one or more of the storage cassettes.

13. The automated teller machine of claim 9 where the document transport system is configured to transport documents between the escrow area and the document receiver.

14. The automated teller machine of claim 9 where the validator is configured to identify and categorize documents when in transit between the escrow area and the document receiver.

15. The automated teller machine of claim 9 where the escrow area is configured to allow for the addition or subtraction of documents from the housing directly from the escrow area.

* * * * *